US006345428B2

(12) United States Patent
Apissomian

(10) Patent No.: US 6,345,428 B2
(45) **Date of Patent: *Feb. 12, 2002**

(54) CHAIR CONSTRUCTION AND METHOD OF MAKING SAME

(75) Inventor: Arthur A. Apissomian, Wadena, MN (US)

(73) Assignee: Homecrest Industries Incorporated, Wadena, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/374,404

(22) Filed: Aug. 13, 1999

(51) Int. Cl.[7] ..... B21D 39/03; A47C 7/00
(52) U.S. Cl. ..... 29/428; 297/440.11
(58) Field of Search ..... 297/452.18, 452.19, 297/452.13, 440.11, 440.1, 452.2, 452.11, 452.12; 29/428

(56) References Cited

U.S. PATENT DOCUMENTS 1,934,307 A * 11/1933 Hardester
2,137,312 A * 11/1938 Thompson
3,235,306 A * 2/1966 Chernivsky
4,049,314 A * 9/1977 McGaffin
4,592,126 A 6/1986 Bottemiller ..... 29/446
4,601,516 A * 7/1986 Klein
4,718,723 A 1/1988 Bottemiller ..... 297/265
4,784,436 A * 11/1988 Sutherland
4,786,106 A 11/1988 Bottemiller ..... 297/265
5,203,611 A * 4/1993 Greenwood
5,360,258 A * 11/1994 Alivizatos
5,393,126 A * 2/1995 Boulva

* cited by examiner

*Primary Examiner*—Milton Nelson, Jr.
(74) *Attorney, Agent, or Firm*—Kinney & Lange, P.A.

(57) ABSTRACT

A method of constructing a chair is used to attach a flexible envelope portion to a support structure. The flexible envelope portion includes two layers of fabric material, with an opening proximate one side. The support structure includes first and second spaced-apart rails having a plurality of studs engaged by a plurality of cross braces. Initially, the rails are held apart by a resilient wire member which is attached to the top of each rail. The structure is inserted within the flexible envelope, and the rails are spaced apart to provide tension to the flexible envelope. The plurality of cross braces are attached to the rails to maintain the tension in the envelope. The wire member and the flexible envelope have an arcuate shape which provides an aesthetically pleasing contour to the top of the back of the chair. Additionally, the wire member provides head support, adding to the overall comfort of the chair.

7 Claims, 5 Drawing Sheets

CHAIR CONSTRUCTION AND METHOD OF MAKING SAME

BACKGROUND OF THE INVENTION

The present invention relates to a chair construction. In particular, it relates to the installment of a fabric envelope having a contoured top end, and an internal wire member having an arcuate shape substantially similar to the top end of the fabric envelope.

Outdoor furniture having an envelope of flexible material stretched over metal framework is quite popular. One example of such furniture is described in the Bottemiller U.S. Pat. No. 4,592,126.

Typically, this type of furniture consists of a fabric sheet held in tension between two longitudinal bars, or a variation thereof. The bars are held apart by a number of external braces. Construction of these chairs sometimes requires the aid of a special tool to space the bars apart, and provide tension to the fabric.

BRIEF SUMMARY OF THE INVENTION

The present invention includes a method of constructing furniture having a flexible envelope in tension and supported by first and second spaced-apart parallel rails held apart by an internal resilient member and a plurality of external cross braces. The flexible envelope is preferably constructed of two sheets of fabric sewn together along the entire perimeter with an opening on the back side of one sheet located near the bottom. The two spaced-apart rails form the structure of the chair, and have slots on the top ends to receive a wire member. The wire member preferably provides an aesthetically pleasing contoured shape to the top of the back of the chair, and acts as an internal brace initially keeping the two rails spaced apart. The resilient wire member also provides tension to the flexible envelope in the top half of the chair during assembly.

The method includes attaching the wire member to the top of each rail. The bottom of the rails are then brought closer to one another. The top of the rails, along with the wire member, are then inserted within the flexible envelope. The top of the flexible envelope is pulled over the wire member and the top of the rails, and the bottom of the flexible envelope is pulled over the bottom of the rails.

DETAILED DESCRIPTION OF THE PREFERRED EMBODIMENTS

Figure 2:
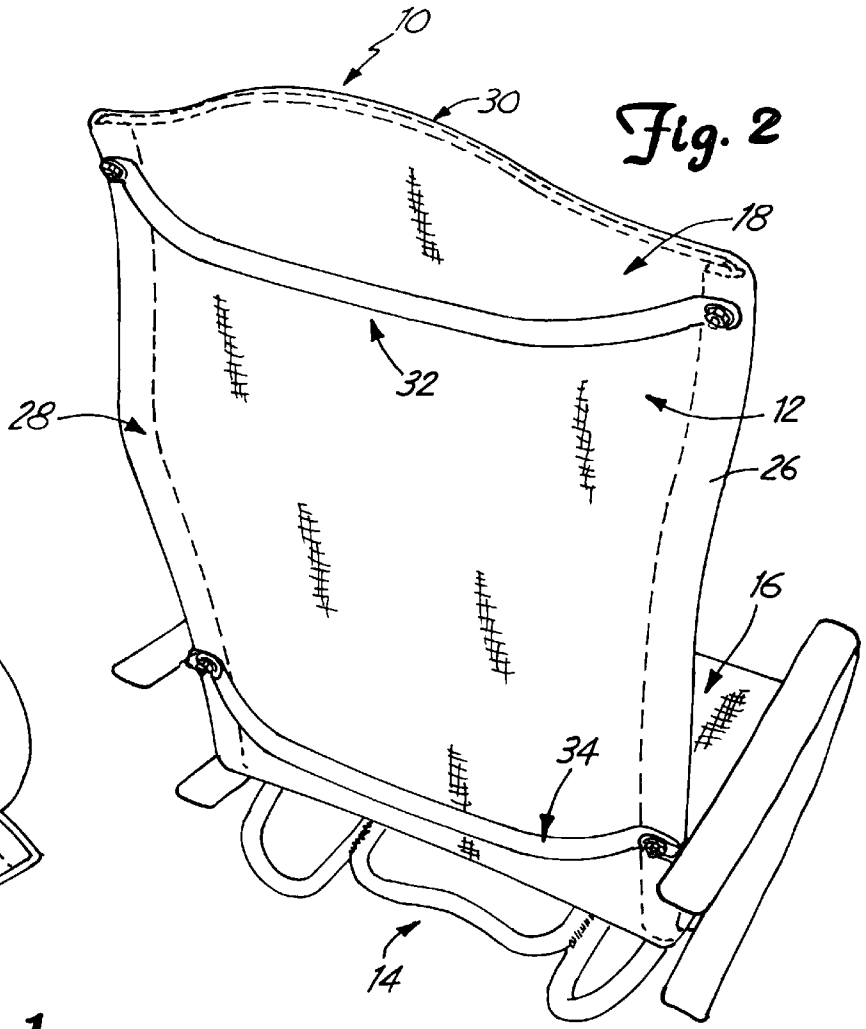
FIG. 2 is a perspective view of the rear portion of the chair.
Figure 1:
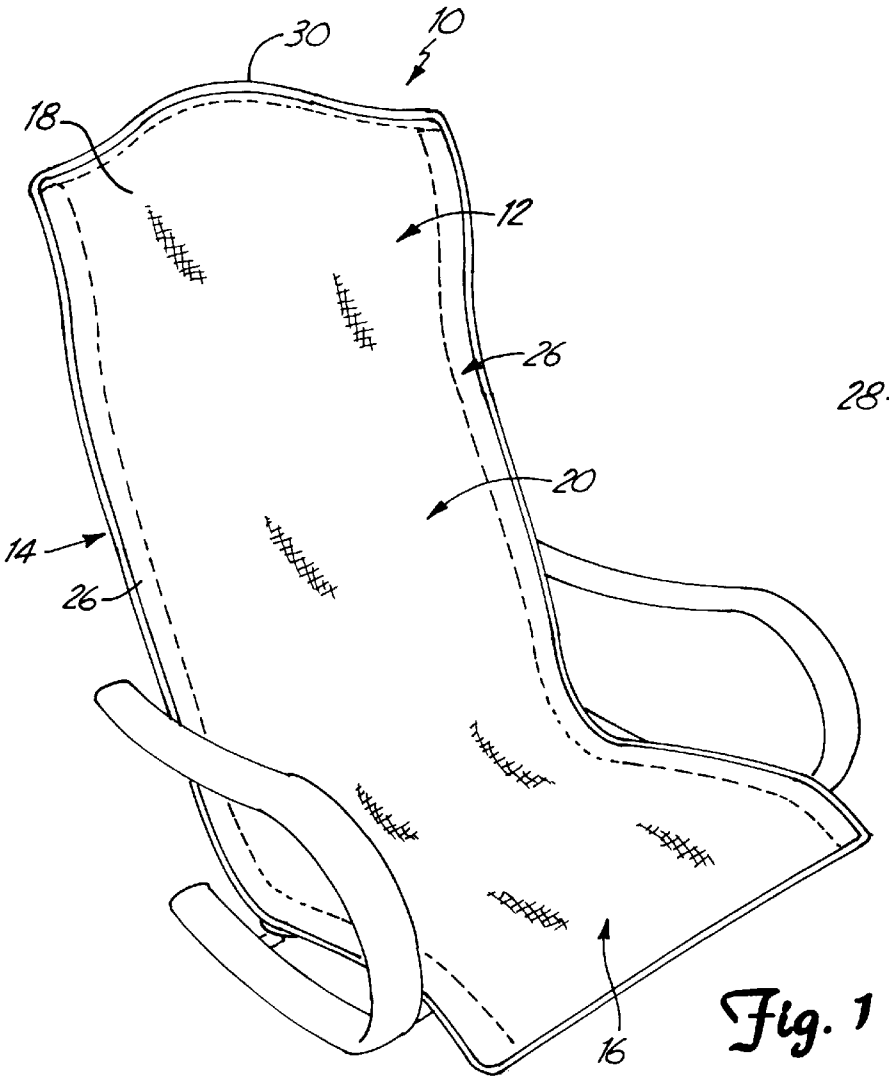
FIG. 1 is a perspective view of the front portion of the chair construction of the present invention.

The chair construction of the present invention is generally indicated at 10 in FIGS. 1 and 2. The chair 10 includes a ground engaging support stand (not shown), a two-piece flexible envelope 12, and a support structure 14 for supporting and holding in tension the flexible envelope 12 and forming a seat and back portion 16 and 18, respectively. As used with this application, the term "construction" refers to both original construction of furniture and reconstruction of furniture to replace the flexible envelope 12.

Figure 3:
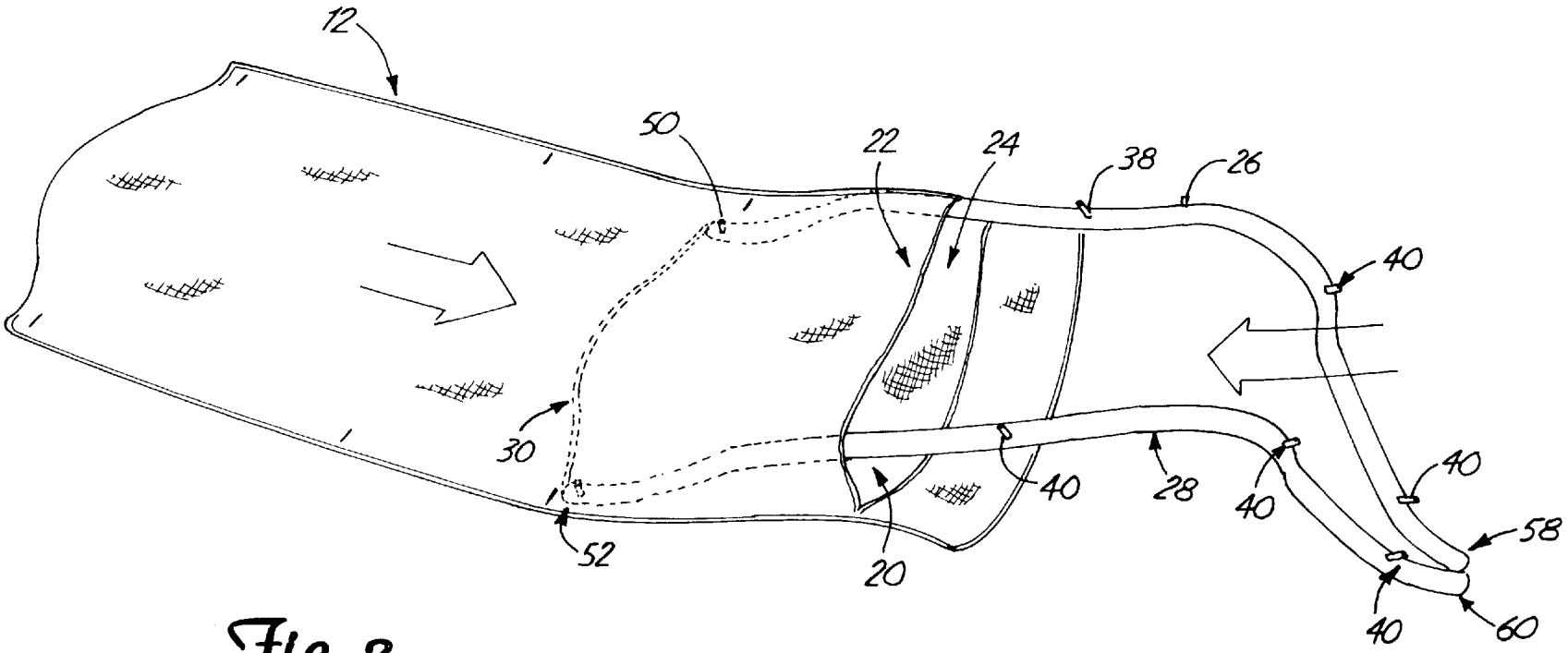
FIG. 3 is a perspective view of the spaced apart rails and wire member being inserted within the flexible envelope.

The flexible envelope 12 is preferably an envelope with an upper layer 20 and a lower layer 22. The upper layer 20 is preferably attached to the lower layer 22 along the entire outside perimeter of each layer. The flexible envelope 12 is preferably made of a fabric, such as vinyl-coated polyester fabric suitable for use in an outdoor environment. The lower layer 22 also contains an opening 24 located near the bottom in which the support structure 14 is inserted, as illustrated in FIG. 3.

Figure 5:
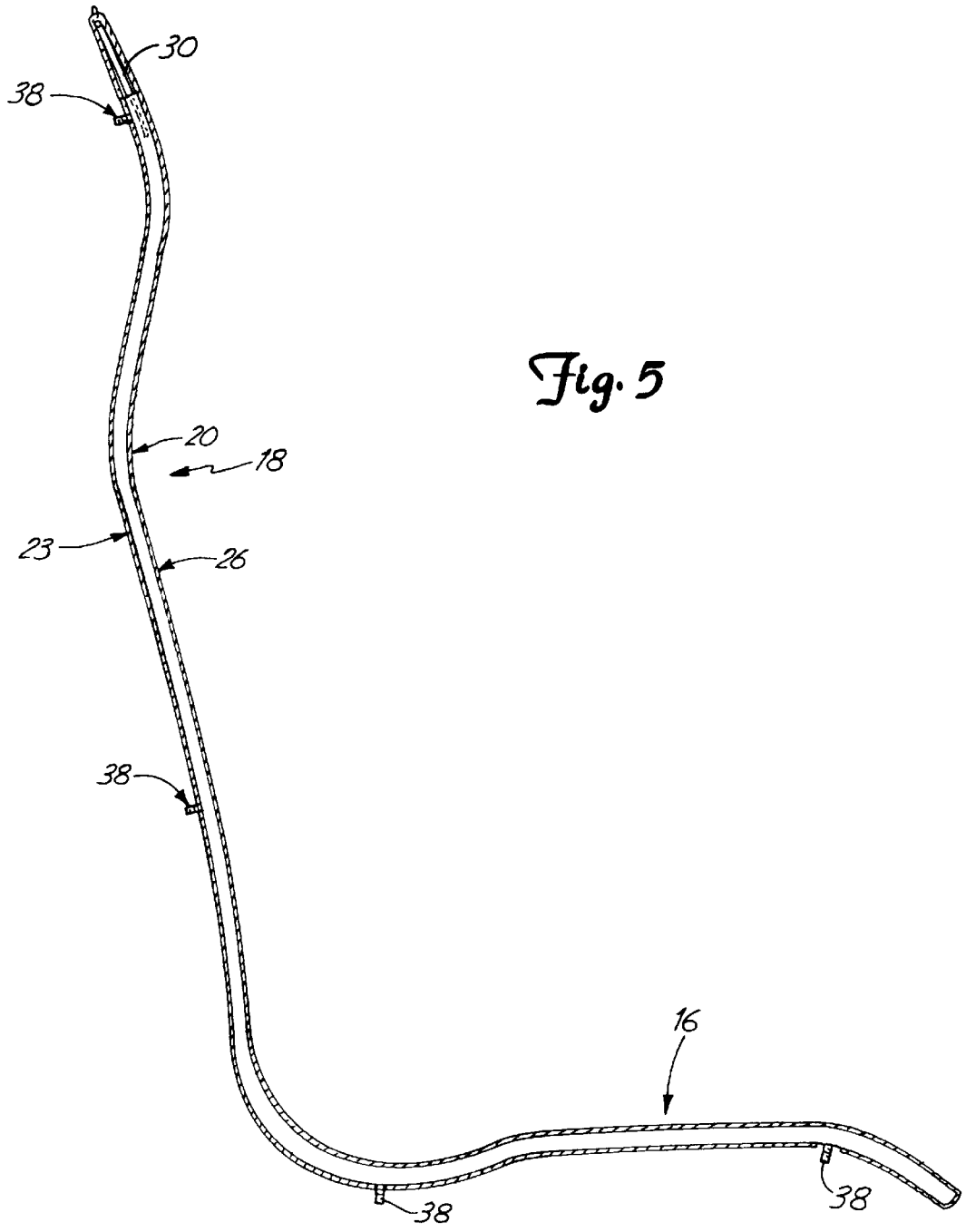
FIG. 5 is a cross-sectional view of the resilient member and a rail enclosed within the envelope.

The support structure 14 includes first and second spaced apart rails 26 and 28, respectively. The rails are approximately "L"-shaped, and preferably have a contour that defines the shape of the chair as illustrated in FIG. 5. When inserted within the flexible envelope 12 and spaced apart, the rails 26 and 28 simultaneously provide the structure and contour for the seat and back portions, 16 and 18, of the chair construction. Thus, the back portion 18 and seat portion 16 are visually continuous with no defining line distinguishing the two.

The rails 26 and 28 are initially held apart at the top of the back portion 18 by a resilient wire member 30, and finally by a plurality of cross braces 32, 34, and 36 located on the seat and back portions 16 and 18. The spaced apart rails 26 and 28 also include a plurality of studs 38 and 40 for engagement with the cross braces 32, 34, and 36 as is well known in the art. It should be understood that the number of cross braces may vary depending on the type of chair, lounge, swing chair, or other similar furniture construction that utilizes a single flexible envelope and similar support structure.

The resilient wire member 30 is preferably made of metal and has a generally central arcuate shape extending in a generally upward direction, with each end 42 and 44 bent approximately perpendicularly downward. The wire member 30 provides flexible, spring-like action which improves head support and the overall comfort of the chair by accommodating to tensions applied upon the flexible envelope from the movement of a sitting occupant. The arcuate shape provides an aesthetically pleasing contoured curve to the top of the back portion of the chair. While the preferred embodiment of the present invention describes the resilient member as having an arcuate shape, it should be understood that alternative embodiments are well within the scope if the present invention. Such alternative embodiments include, but are not limited to, contours with a single or a plurality of raised or lowered portions, straight members, and ornamentally designed members.

Figure 6:
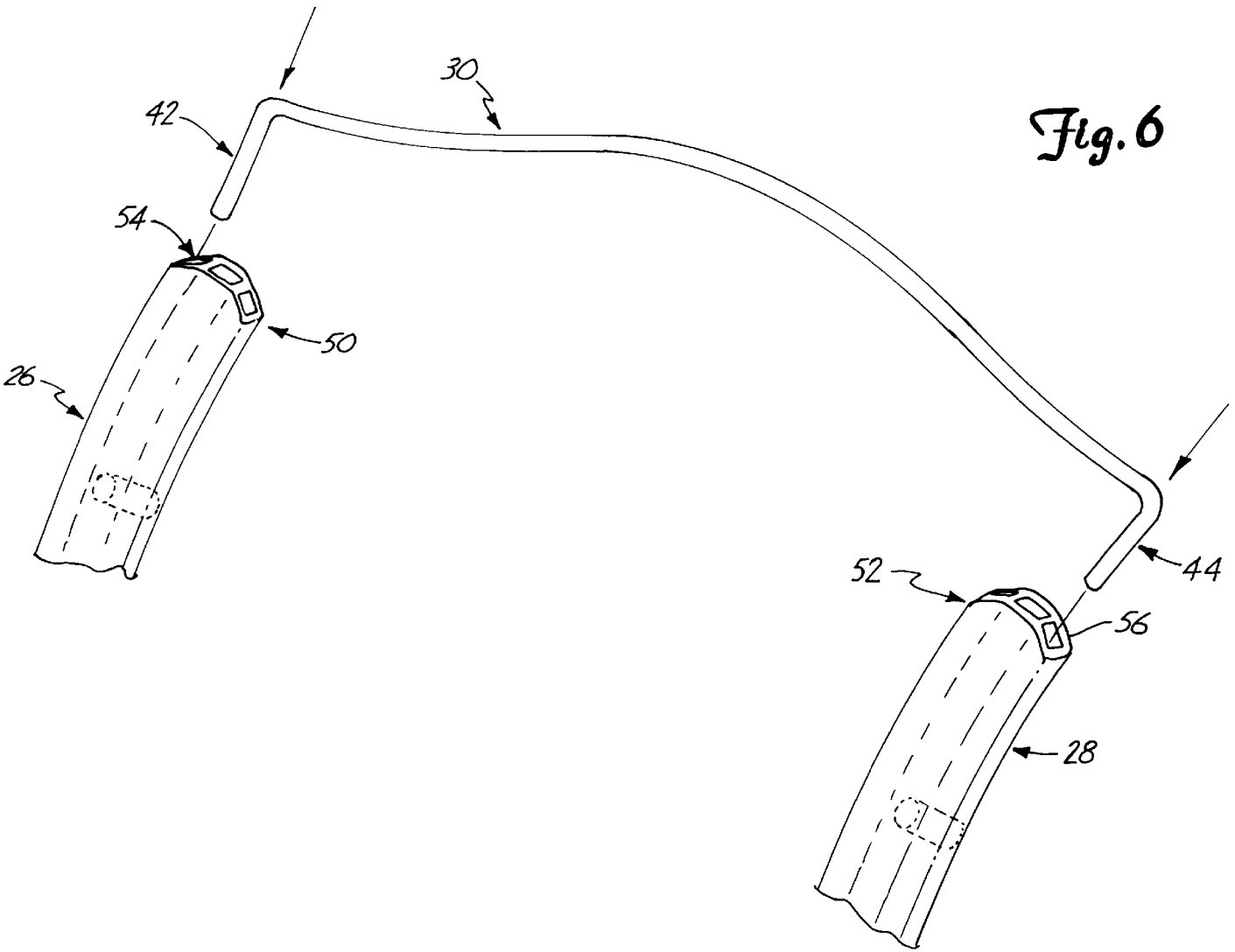
FIG. 6 is a perspective view of the resilient member being inserted into the rails.

In addition, the wire member 30 aids in the construction of the chair. Each rail 50 and 52 includes a slot 54 and 56, respectively, at a top end. These slots 54 and 56 are formed to receive the bent ends 42 and 44 of the resilient member 30, as illustrated in FIG. 6. Once the resilient member 30 has been inserted into the slots 54 and 56, the two rails 26 and 28 are held apart a fixed distance at the top of the rails 50 and 52. This allows the bottom ends 58 and 60 of the rails to be brought closer to one another while the top ends 50 and 52 remain a fixed distance apart from one another. The top ends of the rails 50 and 52 are then inserted within the flexible envelope 12 through the opening 24 located on the lower layer 22 as illustrated in FIG. 3. It should be appreciated that since the bottom ends of the rails 58 and 60 are closer to one another than the top ends of the rails 50 and 52, the flexible envelope 12 is slack and not in tension when the rails 26 and 28 are being inserted within. This increases the ease of assembly of the support structure 14 within the flexible envelope 12.

Figure 4:
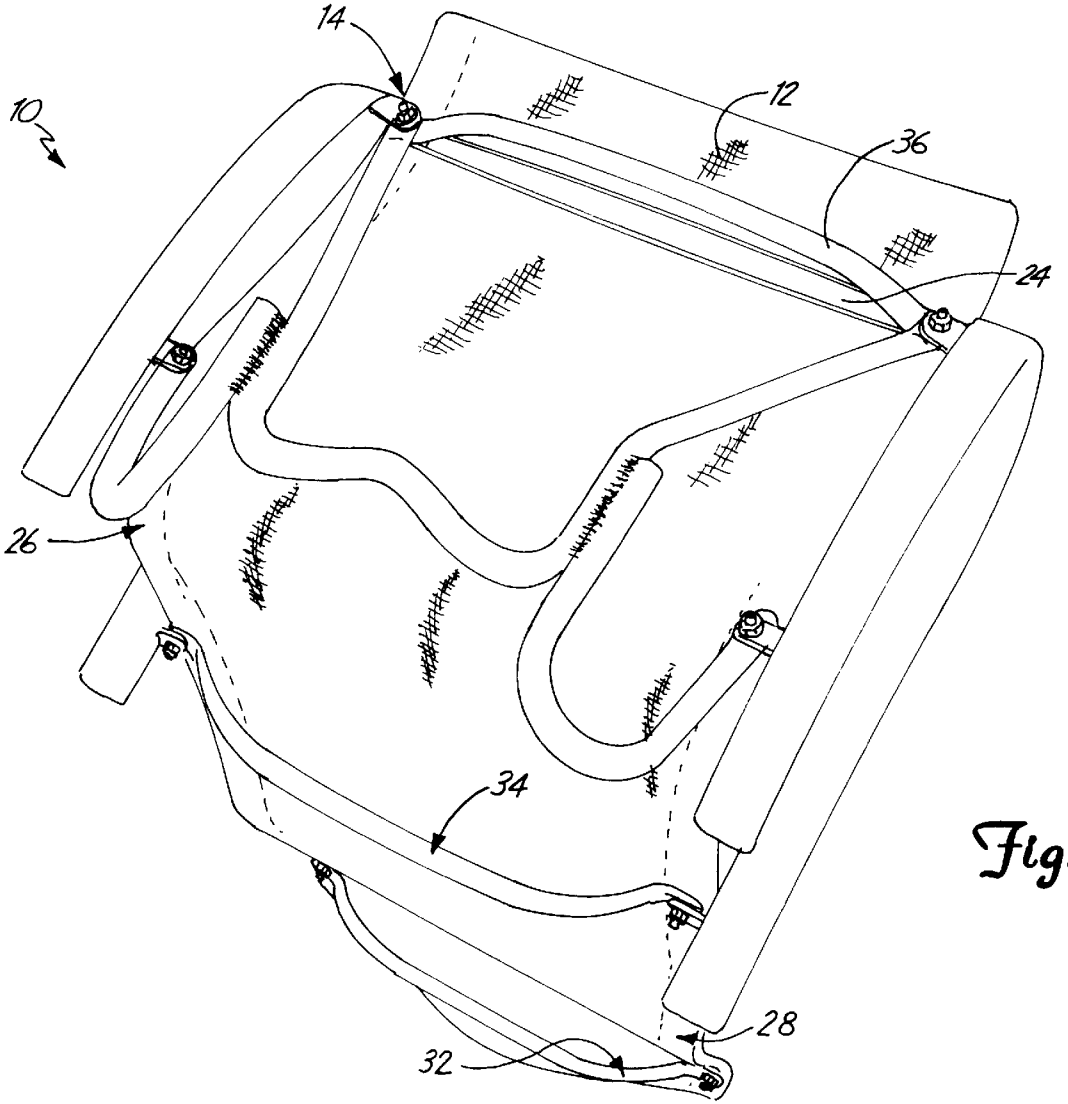
FIG. 4 is a perspective view of the underside portion of the chair.

The spaced apart rails 26 and 28 and flexible member 30 are inserted within the flexible envelope 12 until the top ends of the rails 50 and 52 become adjacent to the top of the flexible envelope 12. The top of the flexible envelope 12 is formed in the shape of a contour that is substantially similar to the contour of the wire member 30, thus the wire member 30 cooperates with the top of the flexible envelope 12. While the bottom ends 58 and 60 of the rails are still close to one another, the lower layer 22 of the bottom of the flexible envelope 12 is placed over the bottom ends 58 and 60 of the rails. The position of the opening 24 in the lower layer 22 of the flexible envelope 12 after assembly is illustrated in FIG. 4.

With the spaced apart rails 26 and 28 fully inserted within the flexible envelope 12, the rails 26 and 28 are positioned so that the flexible envelope 12 is brought into a state of tension. It should be appreciated that the use of a special tool to place the flexible envelope 12 in tension is not needed due to the addition of the internal resilient member 30 located at the top of the spaced apart rails. The resilient member acts as a fulcrum between the two spaced apart rails 26 and 28, which aides in the assembly of the chair. An assembler spaces the bottom of the rails 58 and 60 apart to place the flexible envelope 12 in tension. The assembler then needs only to attach the braces 32, 34, and 36 to the support structure 14, and attach to the chair construction 10 to the ground engaging support stand (not shown).

Although the present invention has been described with reference to preferred embodiments, workers skilled in the art will recognize that changes may be made in form and detail without departing from the spirit and scope of the invention.

What is claimed is:

1. A method of assembling a chair having a pair of substantially parallel rails, each rail having a first end and a second end, the method comprising:

providing a flexible envelope with a first end and a second end, the envelope having an opening located proximate the second end;

inserting an end of a resilient member into the first end of the rail;

inserting an opposite end of the resilient member into the top end of the other rail;

positioning the second ends of the rails closer to one another than the first ends;

inserting the first ends of the rails into the opening of the envelope;

sliding the first end of the envelope over the first end of the rails, until the first ends of the rails are adjacent to the first end of the envelope; and positioning the second end of the envelope over the second ends of the rails.

2. The method of claim 1, wherein the top end of the flexible envelope forms a contour.

3. The method of claim 2, wherein the contour has a raised arcuate shape.

4. The method of claim 1, wherein the resilient member is made of metal.

5. The method of claim 1, wherein the resilient member is flexible.

6. The method of claim 1, wherein the resilient member contains at least one portion that forms a contour.

7. The method of claim 1, wherein the wire member is located within the flexible envelope.

* * * * *